US011168851B1

(12) United States Patent
Chen

(10) Patent No.: US 11,168,851 B1
(45) Date of Patent: Nov. 9, 2021

(54) DECORATIVE NET LIGHT STRUCTURE

(71) Applicant: ZHU HAI FUYUN LIGHTING INDUSTRIAL CO., LTD., Zhuhai (CN)

(72) Inventor: Su-Hua Chen, Zhuhai (CN)

(73) Assignee: ZHU HAI FUYUN LIGHTING INDUSTRIAL CO., LTD., Zhuhai (CN)

( * ) Notice: Subject to any disclaimer, the term of this patent is extended or adjusted under 35 U.S.C. 154(b) by 0 days.

(21) Appl. No.: 17/012,667

(22) Filed: Sep. 4, 2020

(51) Int. Cl.
*F21S 4/15* (2016.01)
*F21V 15/01* (2006.01)
*F21Y 115/10* (2016.01)

(52) U.S. Cl.
CPC ..... *F21S 4/15* (2016.01); *F21V 15/01* (2013.01); *F21Y 2115/10* (2016.08)

(58) Field of Classification Search
CPC ..... F21S 4/10; F21S 4/15; A47G 2033/0827; A47G 33/0836; F21V 23/001; F21V 23/002; F21V 19/0005; F21V 19/001; F21V 19/0015; F21V 19/002; F21V 19/0025; F21V 17/164; F21V 23/00
USPC ..... 362/249.06, 249.16, 391
See application file for complete search history.

(56) References Cited

U.S. PATENT DOCUMENTS 5,645,342 A * 7/1997 Chang ..... F21S 4/10 362/123
5,662,409 A * 9/1997 Huang ..... F21V 21/08 362/123
5,667,295 A * 9/1997 Tsui ..... F21V 17/04 362/249.15
5,716,124 A * 2/1998 Hsu ..... F21S 4/10 362/123
5,775,802 A * 7/1998 Kuo ..... F21S 4/10 362/249.01
5,893,634 A * 4/1999 Wang ..... F21S 4/15 362/249.01
5,951,146 A * 9/1999 Lin ..... F21S 4/10 362/391
6,184,629 B1 * 2/2001 Won ..... F21S 4/10 315/185 S
6,213,624 B1 * 4/2001 Lin ..... F21S 4/10 362/123
6,217,193 B1 * 4/2001 Won ..... F21V 21/088 362/123

(Continued)

*Primary Examiner* — Jong-Suk (James) Lee
*Assistant Examiner* — James M Endo
(74) *Attorney, Agent, or Firm* — Rabin & Berdo, P.C.

(57) ABSTRACT

A decorative net light structure includes a light string and a plurality of light diffusion protective covers. The light string includes two circuits extended parallel to each other, and a plurality of LED light balls arranged spaced apart from each other in an equal distance and connected between the two circuits, and extending roundabout to form a plurality of sections of equal length and arranged in an opposite direction, thereby allowing lighting spots of each section to correspond to nodes of the next section. In addition, the light diffusion protective covers are used to cover and secure the lighting spots and nodes corresponding to each other. Accordingly, the decorative net light structure requiring a simple manufacturing process and having a firm structure can be achieved while being able to protect the light sources and to provide light diffusion effect at the same time.

20 Claims, 6 Drawing Sheets

(56) References Cited

U.S. PATENT DOCUMENTS

| | | | | |
|---|---|---|---|---|
| 6,267,486 | B1 * | 7/2001 | Tai | F21V 21/088 362/249.01 |
| 6,309,087 | B1 * | 10/2001 | Huang | F21S 4/10 362/249.15 |
| 6,367,951 | B1 * | 4/2002 | Kumada | F21S 4/15 362/249.15 |
| 2004/0184285 | A1 * | 9/2004 | Hoffbauer | F21V 5/06 362/555 |
| 2005/0099811 | A1 * | 5/2005 | Cheng | F21S 4/10 362/249.01 |
| 2007/0159109 | A1 * | 7/2007 | Gibboney | H05B 45/50 315/185 S |
| 2009/0146910 | A1 * | 6/2009 | Gardner | F21S 4/15 345/1.3 |
| 2015/0219326 | A1 * | 8/2015 | Verheyen | F21V 23/003 362/249.02 |
| 2017/0023223 | A1 * | 1/2017 | Tsai | F21V 23/003 |
| 2017/0114967 | A1 * | 4/2017 | Chen | H01R 25/003 |
| 2018/0135818 | A1 * | 5/2018 | Chang | F21S 4/15 |
| 2018/0259167 | A1 * | 9/2018 | Krieger | F21K 9/20 |
| 2019/0368670 | A1 * | 12/2019 | Gao | F21S 4/15 |

* cited by examiner

DECORATIVE NET LIGHT STRUCTURE

BACKGROUND OF THE INVENTION

1. Technical Field

The present invention relates to a light fixture for decoration, and in particular, to a net light structure with a stable connecting structure and capable of facilitating the manufacturing process.

2. Description of Related Art

Most of known net light products are formed by intertwining of a plurality of light string, followed by performing electrical circuit connections at the head and rear ends of each light string. Consequently, such known net light products are of complicated manufacturing process and simplified standard process cannot be achieved easily. In addition, the securement locations of light element connections are not properly protected such that they are prone to damages, peeling off or circuit disconnection, leading to short product lifetime. Furthermore, most of the known light strings adopt the serial connection method such that the overall product is likely to encounter the problem of limitation in light tree application or voltage issue, leading to the drawbacks of incoherence or instability in terms of the utilization of such known products for decoration purposes. In view of the above, there is a need to overcome the drawbacks of known products and problems associated to the application thereof.

BRIEF SUMMARY OF THE INVENTION

The primary objective of the present invention is to provide a decorative net light structure having a simple and stable structure with excellent protection effect and durability. With the utilization of a single roundabout and winding light string as well as the use of light diffusion protective covers to provide the effects of securement, protection and light diffusion for the light source connecting points, the overall practicality and durability of the product can be improved, and the production cost can be significantly reduced through simplified process and standardized manufacturing steps.

Furthermore, the present invention adopts the light string structure with the use of two circuits of LED chips connected in parallel, such that it can be driven by low-voltage DC power, thereby preventing impacts of frequency fluctuation on the light emission, such that the product is able to achieve stable light emitting effect, which is also different from the large diameter of circuits for traditional high voltage power that may affect the sophisticated and appealing characteristics of the light string.

To achieve the aforementioned effects and objectives, the technique and structural characteristics mainly adopted by the present invention comprises a light string and a plurality of light diffusion protective overs; the light string having a plurality of LED light balls arranged spaced apart from each other in an equal distance, and a conductive wire of the light string comprising a first circuit and a second circuit extended parallel to each other, and the plurality of LED light balls connected between the first circuit and the second circuit and arranged parallel to each other; wherein a location of each one of the LED light balls on the light string is a lighting spot, a location adjacent to each of the LED light balls and separated by a distance is a node, the light string extends roundabout to sequentially and repetitively form a plurality of sections of an equal length, thereby allowing the lighting spot of each one of the sections corresponding to the node of the next section; the plurality of light diffusion protective covers for covering and securing the plurality of lighting spots and nodes corresponding to each other in the string; wherein each one of the light diffusion protective covers includes a through-type accommodating slot; the accommodating slot is configured to receive the lighting spot and the node corresponding to each other therein, and one side edge of the light diffusion protection cover includes a slot opening formed adjacent to a side edge of the accommodating slot and provided to allow the conductive wire of the light string to pass therethrough.

In a feasible embodiment, the light string further defines a lighting spot and a node between each two adjacent sections to be a roundabout lighting spot and a roundabout node respectively, and the light diffusion protective cover covers and secures the roundabout lighting spot and the roundabout node, thereby allowing the conductive wire between the roundabout lighting spot and the roundabout node to form a mounting ring, thereby facilitating the mounting onto a predefined carrier during use and increasing the convenience of use.

Furthermore, the light string further defines a lighting spot and a node between at least one of each two adjacent sections to be a roundabout lighting spot and a roundabout node respectively, and the light diffusion protective cover covers and secures the roundabout lighting spot and the roundabout node, thereby allowing the conductive wire between the roundabout lighting spot and the roundabout node to form a mounting ring.

In addition, to prevent any insufficient protection and stability of LED light balls at the final section of the light string provided by the light diffusion protective covers, in a feasible embodiment, an auxiliary wire can be further arranged adjacent to a last section of the light string; the auxiliary wire comprises a plurality of nodes corresponding to the plurality of lighting spots of the last section respectively, and the plurality of light diffusion protective covers cover and secure the plurality of lighting spots and the nodes corresponding to each other on the last section and auxiliary wire.

To further enhance the practical application of the present invention, in a feasible embodiment, it can further include an extension module; the extension module comprises a male connector, a female connector and two extension wires; the two extension wires connected between the male and female connectors and arranged adjacent to the first section and the last section of the light string, and at least one of the extension wires penetrating through at least one of the plurality of mounting rings; wherein the extension wire arranged adjacent to the first section is electrically connected to the first circuit and comprises a plurality of positioning points corresponding to the plurality of nodes of the first section respectively, and the plurality of light diffusion protective covers cover and secure the plurality of nodes and the positioning points corresponding to each other on the first section and on the adjacent extension wire; and the extension wire arranged adjacent to the last section is electrically connected to the second circuit and comprises a plurality of nodes corresponding to the plurality of lighting spots of the last section respectively, and the plurality of light diffusion protective covers cover and secure the plurality of lighting spots and the nodes corresponding to each other on the last section and on the adjacent extension wire.

According to the aforementioned structure of the present invention, wherein each one of the light diffusion protective covers has any one of a ball shape, a dome shape, a cylindrical shape, a rectangular shape and a polygonal shape, and is mainly made of a transparent or semi-transparent material. In addition, each one of the light diffusion protective covers comprises an outer surface away from the slot opening, and the outer surface is of a convex surface, concave surface or flat surface, or it can also be a polyhedral structure similar to a diamond surface (convex or concave polyhedral structure). Moreover, the outer surface can also be configured to a glossy surface or a matte surface.

According to the aforementioned structure of the present invention, the LED light balls on the light strip utilizes micro LED chips attached onto the conductive wire of the string and are connected to the first circuit and the second circuit with two electrodes respectively. In addition, the distance of each node away from the lighting spot on the light string is approximately equivalent to half of the distance between two lighting spots.

According to the aforementioned structure, each one of the light diffusion protective covers mainly receives each lighting spot and node or each node and positioning point therein via bonding securement. The gel used can be UV gel such that ultraviolet (UV) light can be projected on the gel in order to achieve simple and fast manufacturing process and to properly stabilize and protect the LED light ball received inside the light diffusion protective cover.

According to the aforementioned structure of the present invention, the male connector and female connector of the extension module can choose to use the general type of DC Jack, USB or dual-pin type etc. in order to satisfy the practicality of actual application.

DETAILED DESCRIPTION OF THE INVENTION

Figure 1:
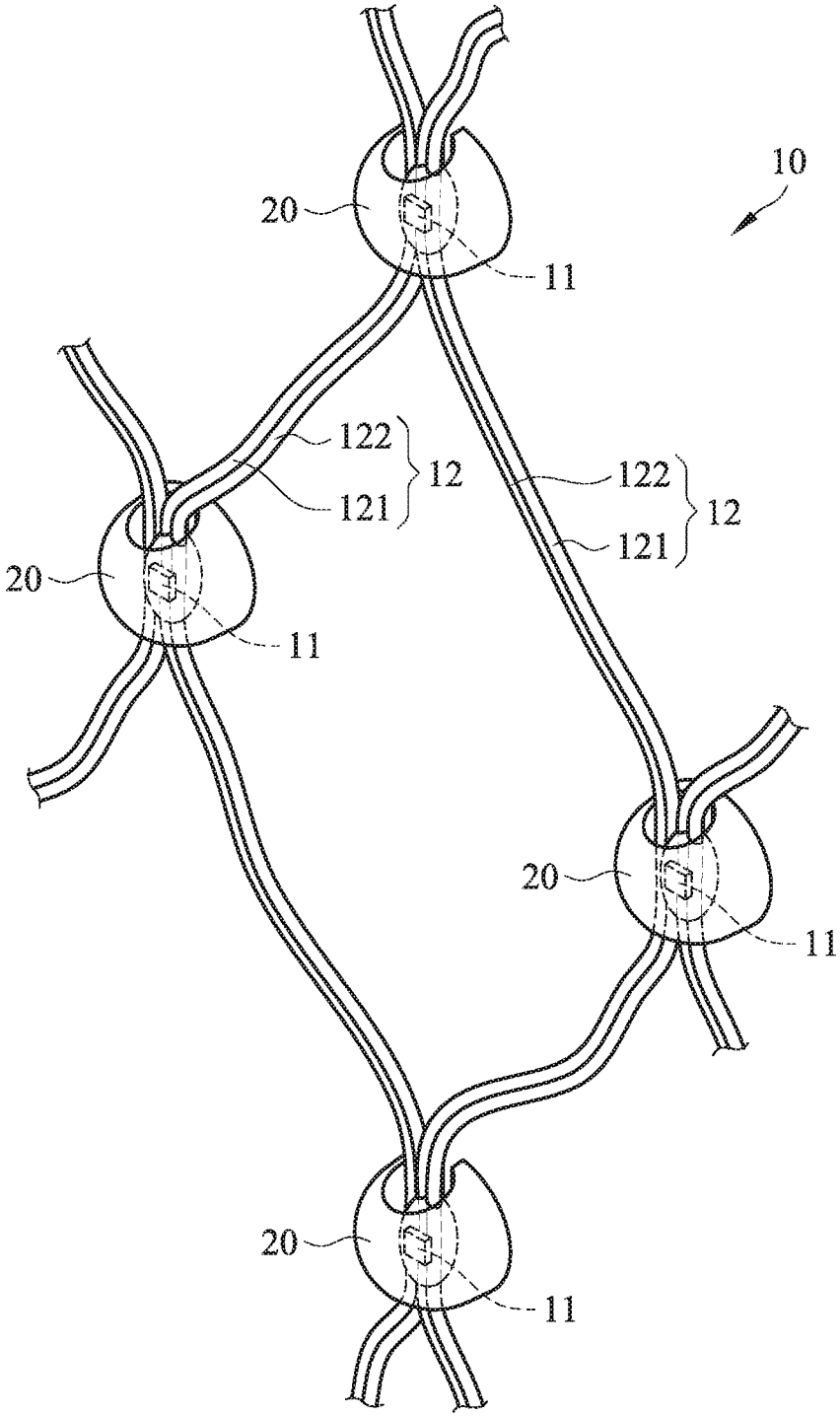
FIG. 1 is a partial outer appearance view of the decorative net light structure of the present invention.
Figure 2:
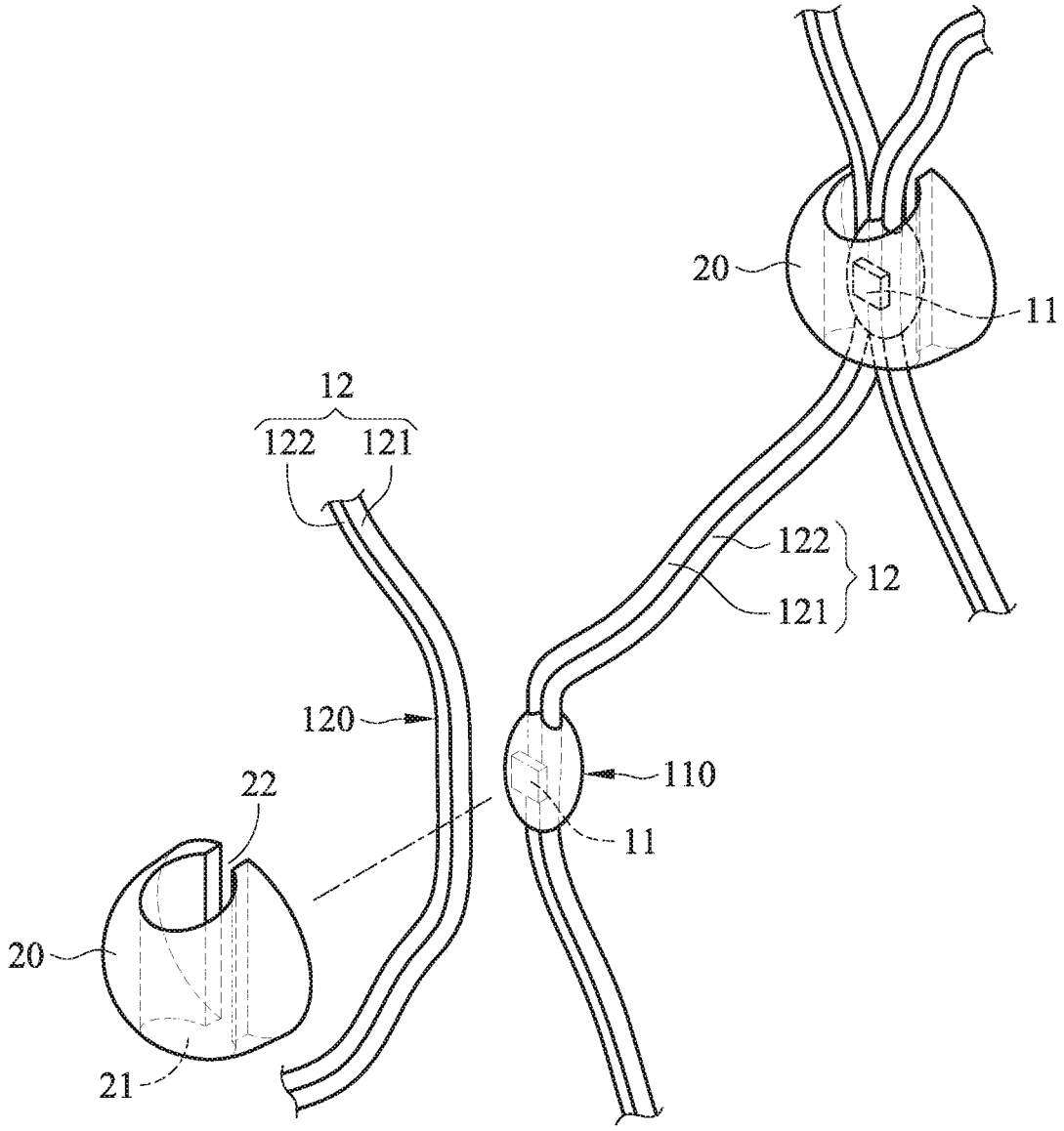
FIG. 2 is an illustration showing the assembly of light diffusion protective cover and the light string of the present invention.
Figure 5:
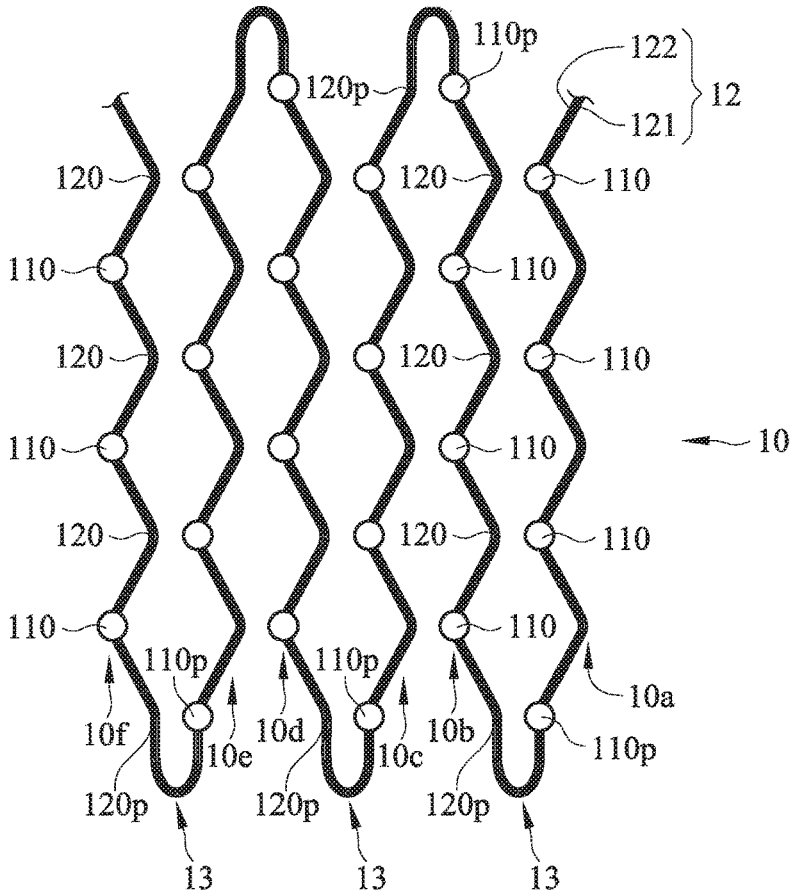
FIG. 5 is an illustration showing another roundabout arrangement of the light string of the present invention.

As shown in FIG. 1 and FIG. 5, the main structure of the present invention comprises a light string 10 and a plurality of light diffusion protective covers 20. The present invention mainly utilizes the light string 10 having a plurality of LED light balls 11 extending roundabout for arrangement and securement, followed by using the light diffusion protective covers 20 to cover and secure the plurality of LED light balls 11 and the adjacent conductive wire 12 to form the decorative net light structure.

Figure 4:
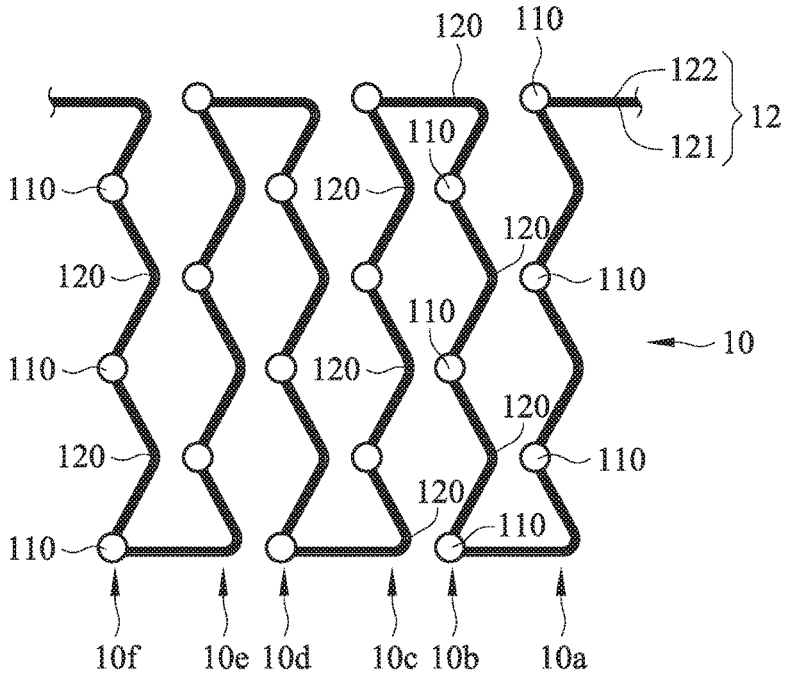
FIG. 4 is an illustration showing a roundabout arrangement of the light string of the present invention.

In addition, the light string 10 used by the present invention mainly comprises a conductive wire 12 and a plurality of LED light balls 11. The conductive wire 12 comprises a first circuit 121 and a second circuit 122 extended parallel to each other, and the plurality of LED light balls 11 are arranged spaced apart from each other at equal distance on the conductive wire 12. Furthermore, the two electrodes of each LED light ball 11 are electrically connected to the first circuit 121 and the second circuit 122 respectively; i.e. the plurality of LED light balls 11 are connected between the first circuit 121 and the second circuit 122. Moreover, in the present invention, the location of each LED light ball 11 on the light string is used as a lighting spot 110, and a location adjacent to each LED light ball 11 and separated by a distance is a node 120. Such distance can be equivalent to half of the distance between two LED light balls 11. In addition, the light string 10 can extend roundabout to sequentially and repetitively form a plurality of sections of an equal length. As shown in FIG. 4 and FIG. 5, the light string 10 extends roundabout to form a first section 10*a* (i.e. the first section), a second section 10*b*, a third section 10*c*, a fourth section 10*d*, a fifth section 10*e* . . . and an n section 10*f* (i.e. the last section), in order to allow the lighting spot 110 of each section to be able to correspond to the node 120 of the next section.

The plurality of light diffusion protective covers 20 are mainly configured to cover and secure the plurality of lighting spots 110 and the nodes 120 corresponding to each other on the light string 10, such that each light source connecting portion can be secured to form a decorative net light structure, and they are also equipped with the functions of protecting the light sources and achieving the light diffusion effect. In addition, the main structure of the light diffusion protective cover 20 includes a light transmissive housing, and such housing can be made of a transparent or semi-transparent material. The internal of the housing includes a through-type accommodating slot 21 formed therein, and one side edge of the accommodating slot 21 includes a slot opening 22 formed thereon and provided to allow the conductive wire 12 of the light string 10 to pass therethrough, such that the light diffusion protective cover 20 is able to use the slot opening 22 to cover the conductive wire 12. The relative position can be adjusted to allow the accommodating slot 21 to be located at a position of the corresponding lighting spot 110 and the node 120, in order to receive and secure the corresponding lighting spot 110 and the node 120.

Figure 3A:
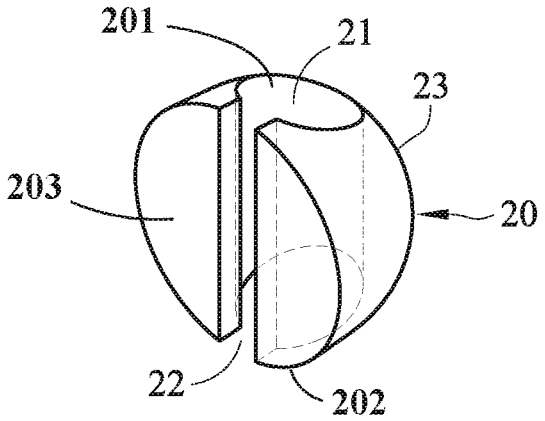
FIG. 3A to FIG. 3D are outer appearance views of the light diffusion protective cover.
Figure 3B:
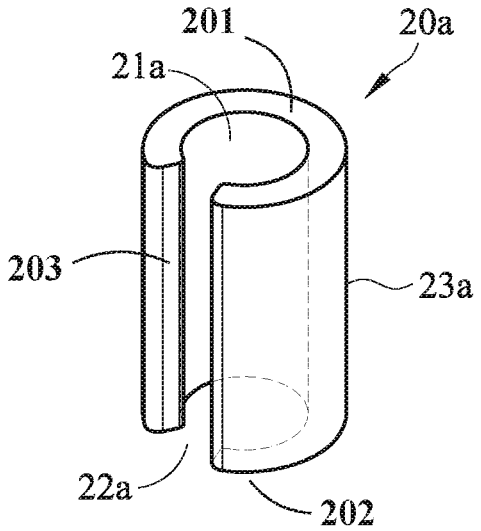
Figure 3C:
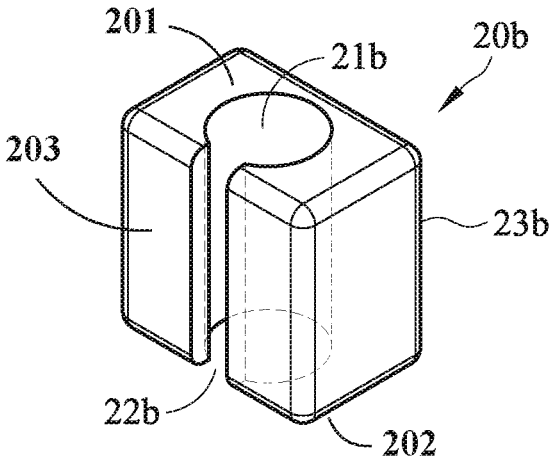
Figure 3D:
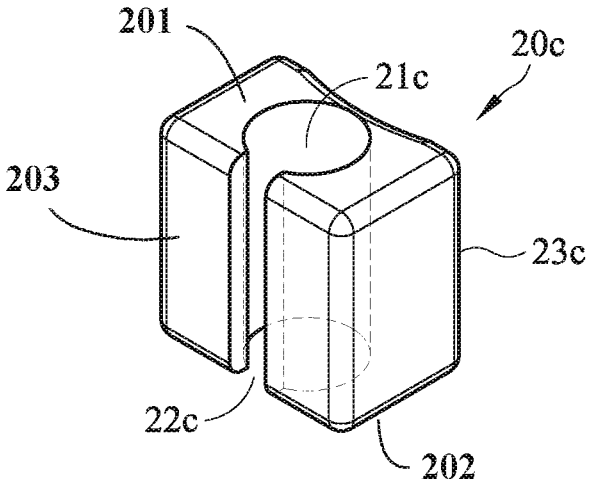

In a feasible embodiment, the light diffusion protective covers 20 can have different shapes to achieve the desired lighting effect. As shown in FIG. 3A, the ball type of light diffusion protective cover 20 (can be ball shape or dome shape) includes the through-type accommodating slot 21 and the slot opening 22 as well as an outer surface 23 facing away from the slot opening 22. As shown in FIG. 3A, the light diffusion protective cover 20 has two opposite ends that are a first end 201 and a second end 202, and that are connected by at least one side surface including a first side surface 203. The through-type accommodating slot 21 penetrates the light diffusion protective cover 20 from the first end 201 to the second end 202. The slot opening 22 of the through-type accommodating slot 21 is formed on the first side surface 203, and extends from the first end 201 to the second end 202. The slot opening 22 has a width that is narrower than a diameter of the through-type accommodating slot 21. In addition, as shown in FIG. 3B, the cylindrical light diffusion protective over 20*a* includes a through-type accommodating slot 21*a* and the slot opening 22*a* as well as an outer surface 23*a* facing away from the slot opening 22*a*. Furthermore, as shown in FIGS. 3C and 3D, each one of the rectangular light diffusion protective covers 20*b*, 20*c* includes a through-type accommodating slot 21*b*, 21*c* and a slot opening 22*b*, 22*c* as well as an outer surface 23*b*, 23*c* facing away from the slot opening 22*b*, 22*c*. In addition, according to each type of shape and style, the outer surface can have a glossy surface or a matte surface, and its surface shape can be a convex surface (such as the ball type or cylindrical shape of outer surface 23, 23*a*), or it can be a flat surface (such as the rectangular outer surface 23*b*) or a concave surface (such as the rectangular outer surface 23*c*), or the outer surface can even be configured to be a polyhedral structure similar to a diamond shape, in order to achieve the expected light diffusion effect and satisfy various appealing and decorative requirements.

With regard to the manufacturing process of the present invention, it mainly utilizes a plurality of transparent light diffusion protective covers 20 having a narrow slot opening 22 and a wide accommodating slot 21, in conjunction with the auxiliary strip mold injection and gel applying tools. The molding method can be used to pour UV gel into the accommodating slot 21 of the light diffusion protective cover 20 in order to allow the UV gel to properly cover the lighting sot 110 of the LED light ball 11 and the node 120 of the conductive wire 12; following which ultraviolet (UV) light can be projected to excite the UV gel to generate chemical curing effect in order to firmly secure the lighting spot 110 and the node 120 inside the light diffusion protective cover 20. During the process, spill of excessive gel can be preventing with proper adjustment and control of the gel. Through quick and simple repetitive process, a light string 10 can be formed to have a net structure consisting a plurality of meshes, thereby achieving the decorative net light structure of the present invention.

In addition, as shown in FIG. 5, when the light string 10 extends roundabout to form the structure of the present invention, a lighting spot 110 and a node 120 can be reserved between the sections (such as between section 10*a* and section 10*b* or between section 10*b* and section 10*c* etc.) and defined as a roundabout lighting spot 110*p* and a roundabout node 120*p*. Furthermore, the light diffusion protective cover 20 can be used to cover and secure the roundabout lighting spot 110*p* and the roundabout node 120*p* in order to allow the conductive wire 12 between the roundabout lighting spot 110*p* and the roundabout node 120*p* to form a mounting ring 13, such that when the present invention is manufactured into a product, the mounting ring 13 can be provided to facilitate the user to mount it onto a predefined carrier in order to achieve convenient use and the purpose of decoration.

Figure 6:
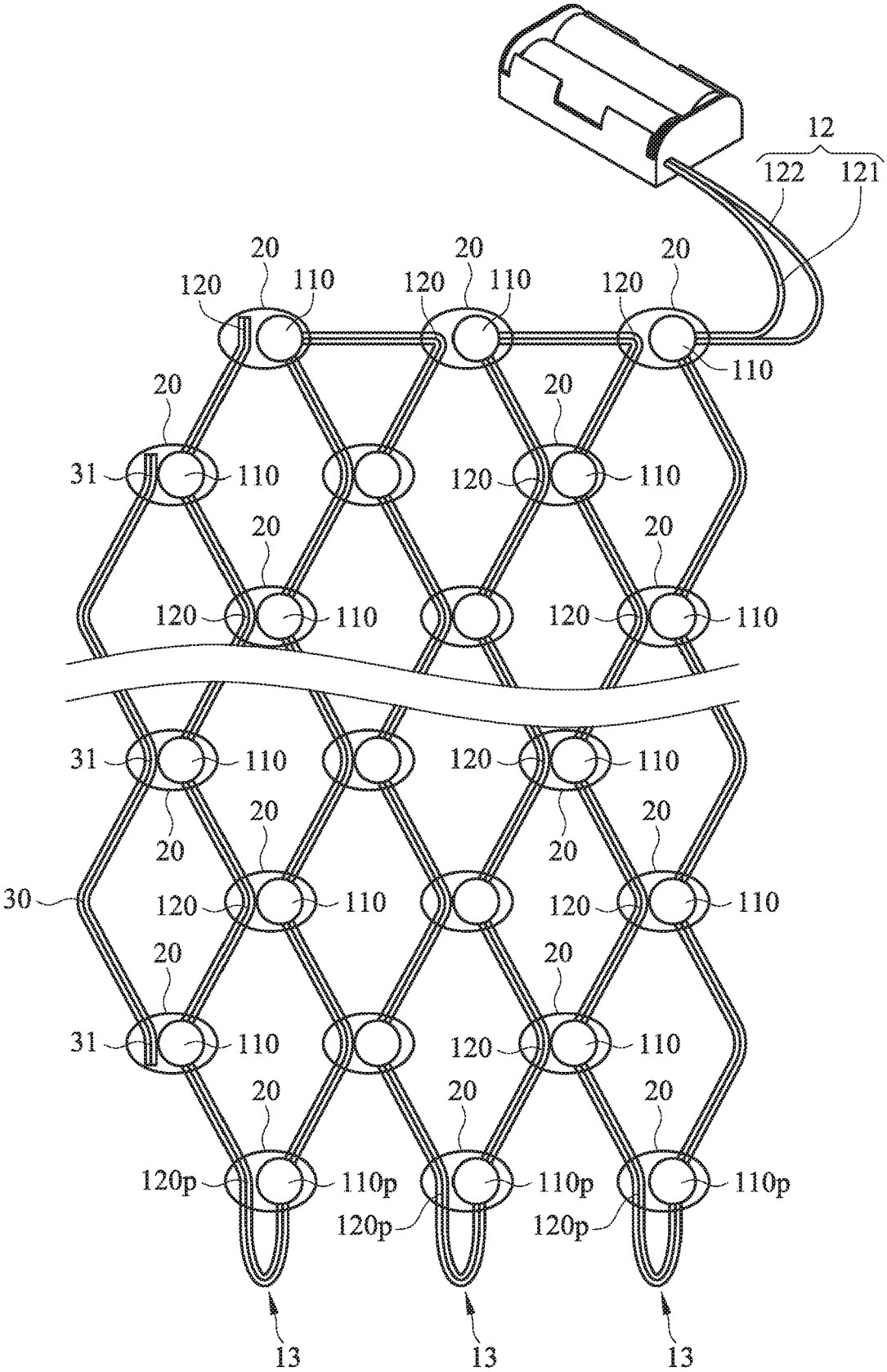
FIG. 6 is an assembly view of the first embodiment of the present invention.

With regard to the actual application of the present invention, as shown in FIG. 6, it can be manufactured into a single decorative net light product. One side of the decorative net light can be connected to a battery box in order to use the battery box to supply power. In this embodiment, one end of the two lines (first circuit 121 and second circuit 122 of the conductive wire 12) of the light string 10 can be connected to the battery box. The light string 10 can extend roundabout repetitively toward the direction of the other end according to a predefined length in order to form a plurality of sections, thereby allowing each section to have the same quantity of lighting spots 110 and nodes 120. Furthermore, the lighting spot 110 of each section is able to correspond to the node 120 of next section, following which the light diffusion protective cover 20 can be used to cover and secure each lighting spot 110 and the node 120 corresponding to each other. In this embodiment, the light string 10 is reserved with the roundabout lighting spots 110*p* and the roundabout nodes 120*p* at the locations between the odd section to even section, thereby allowing the mounting rings 13 to be uniformly formed at one single direction as a whole. In this embodiment, since the lighting spot 110 of the last section has no corresponding next section, an auxiliary line 30 is provided at the side adjacent to the last section in order to secure the lighting spot 110 of the last section; wherein the auxiliary line 30 mainly comprises a plurality of nodes 31 configured to correspond to the lighting spots 110 of the last section, in order to allow each light spot 110 of the last section and each corresponding node 31 on the auxiliary line 30 to be covered and secured by the light diffusion protective cover 20 together, thereby achieving the protection of LED light balls 11 in the lighting spots 110 and the light diffusion effect.

Figure 7:
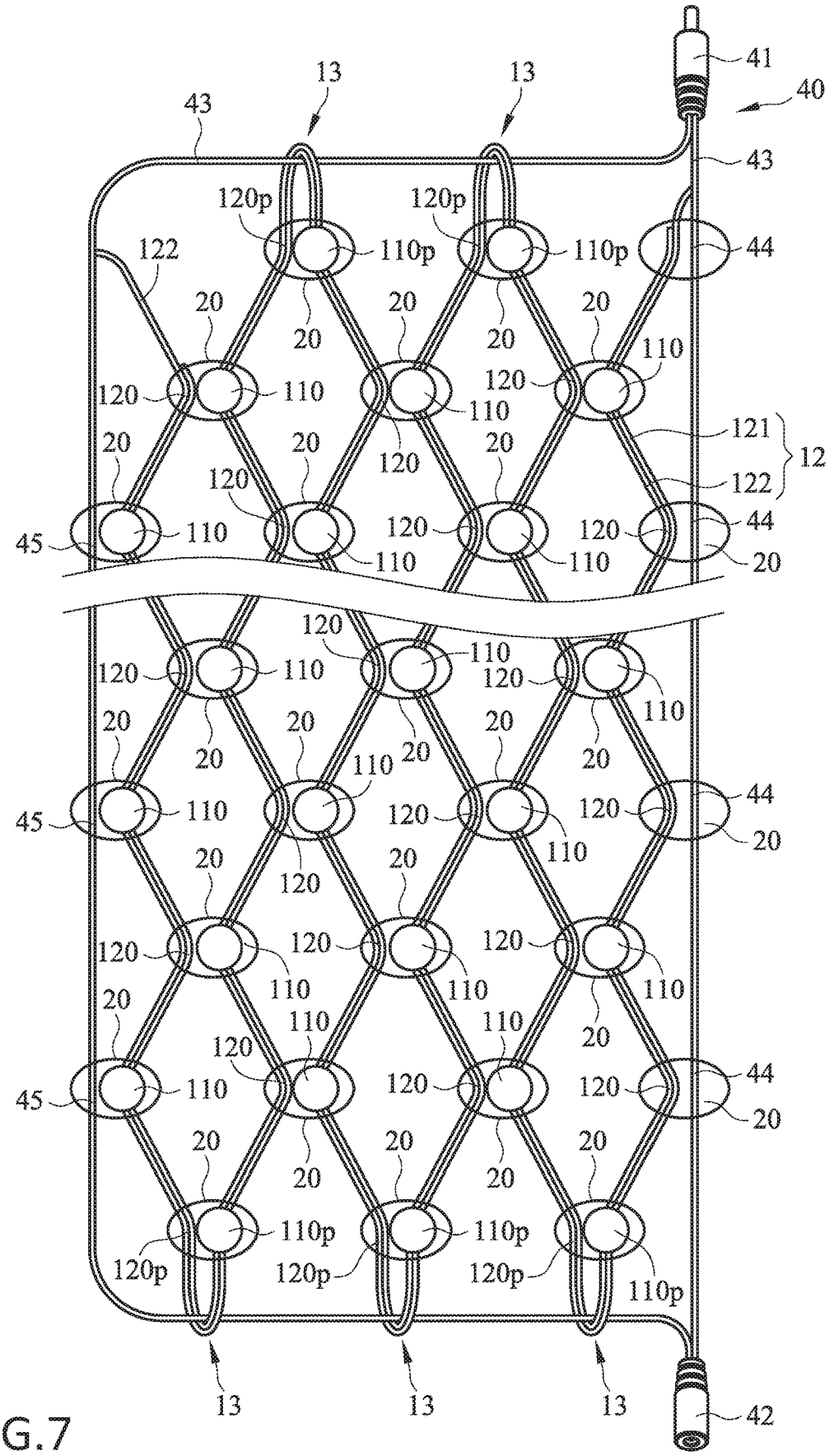
FIG. 7 is an assembly view of the second embodiment of the present invention.

In addition, as shown in FIG. 7, the actual application of the present invention can also include an extension module 40 in order to be manufactured into a decorative net light product capable of being connected to another decorative net light product in series for extension. In this embodiment, the extension module 40 is arranged to surround a surrounding of the light string 10 extending roundabout to form the decorative net light. The light string 10 is predefined to include roundabout lighting spots 110*p* and roundabout nodes 120*p* between the extended roundabout sections, and a plurality of mounting rings 13 are formed at the two upper and lower sides of the light string 10 respectively. The extension module 40 mainly comprises a male connector 41, a female connector 42 and two extension wires 43. The two ends of the two extension wires 43 are connected to the male connector 41 and the female connector 42 respectively. In addition, the two extension wires 43 are arranged adjacent to the first section and the last section of the light string 10 respectively, and at least one of the extension wires 43 penetrates into the mounting ring 13 of the light string 10; wherein the extension wire 43 arranged adjacent to the first section is electrically connected to the first circuit 121, and the extension wire 43 arranged adjacent to the last section is electrically connected to the second circuit 122. Furthermore, the extension wire 43 arranged adjacent to the first section comprises a plurality of positioning points 44 corresponding to the nodes 120 of the first section respectively, allowing the light diffusion protective covers 20 to be able to cover and secure each of the nodes 120 of the first section and each one of the adjacent corresponding positioning points 44 on the extension wire 43. Moreover, the extension wire 43 arranged adjacent to the last section comprises a plurality of nodes 45 corresponding to the lighting spots 110 of the last section respectively, allowing the light diffusion protective covers 20 to be able to cover and secure each of the lighting spots 110 of the last section and each one of the adjacent corresponding nodes 45 on the extension wire 43.

With the aforementioned application method utilizing the extension module 40, users are able to connect decorative net lights in series to achieve an expected length depending upon different use needs, in order to form a desired stylish decoration properly (such as the winding of the lights into a bow tie shape or an animal shape etc.), or to lay or mount the decorative net lights on a predefined space or carrier, thereby achieving the objectives of facilitated installation, use and decoration of the decorative net lights.

It shall be understood that the above describes the preferred embodiments of the present invention only, and any extension, modification, simple change or equivalent replacement made based on the techniques and technical features of the present invention shall be considered to be within the scope of the claims of the present invention.

What is claimed is:

1. A decorative net light structure, comprising:

a light string having a plurality of LED light balls arranged spaced apart from each other in an equal distance, and a conductive wire of the light string comprising a first circuit and a second circuit extended in parallel to each other, the plurality of LED light balls being connected between the first circuit and the second circuit and arranged in parallel to each other, wherein a location of each one of the LED light balls on the light string is a lighting spot, a location adjacent to each of the LED light balls and separated by a distance is a node, and the light string extends roundabout to sequentially and repetitively form a plurality of sections of an equal length, thereby allowing the lighting spot of each one of the sections to correspond to the node of the next section; and a plurality of light diffusion protective covers each covering and securing one of the plurality of lighting spots and one of the plurality of nodes corresponding to each other in the light string, wherein each one of the light diffusion protective covers has two opposite ends that are a first end and a second end, and that are connected by at least one side surface including a first side surface, a through-type accommodating slot penetrating said each light diffusion protective cover from the first end to the second end, for receiving the lighting spot and the node corresponding to each other therein, a slot opening of the through-type accommodating slot being formed on said first side surface and extending from the first end to the second end, and the slot opening of the through-type accommodating slot is provided to allow the conductive wire of the light string to pass therethrough, and has a width that is narrower than a diameter of the through-type accommodating slot.

2. The decorative net light structure according to claim 1, wherein the light string further defines a lighting spot and a node between each two adjacent sections to be a roundabout lighting spot and a roundabout node respectively, and the light diffusion protective cover covers and secures the roundabout lighting spot and the roundabout node, thereby allowing the conductive wire between the roundabout lighting spot and the roundabout node to form a mounting ring.

3. The decorative net light structure according to claim 2, further comprising an extension module;

wherein the extension module comprises a male connector, a female connector and two extension wires, the two extension wires connected between the male and female connectors and arranged adjacent to a first section and a last section of the light string, and at least one of the extension wires penetrating through at least one of the plurality of mounting rings;

wherein the extension wire arranged adjacent to the first section is electrically connected to the first circuit and comprises a plurality of positioning points corresponding to the plurality of nodes of the first section respectively, and the plurality of light diffusion protective covers cover and secure the plurality of nodes and the positioning points corresponding to each other on the first section and on the adjacent extension wire; and wherein the extension wire arranged adjacent to the last section is electrically connected to the second circuit and comprises a plurality of nodes corresponding to the plurality of lighting spots of the last section respectively, and the plurality of light diffusion protective covers cover and secure the plurality of lighting spots and the nodes corresponding to each other on the last section and on the adjacent extension wire.

4. The decorative net light structure according to claim 3, wherein each one of the light diffusion protective covers is made of a transparent or semi-transparent material.

5. The decorative net light structure according to claim 4, wherein the at least one side surface further includes a second side surface, and the second side surface is a convex surface, concave surface or flat surface.

6. The decorative net light structure according to claim 5, wherein each of the at least one side surface is a glossy surface or a matte surface.

7. The decorative net light structure according to claim 6, wherein each one of the light diffusion protective covers has any one of a ball shape, a dome shape, a cylindrical shape, a rectangular shape and a polygonal shape.

8. The decorative net light structure according to claim 1, wherein the light string further defines a lighting spot and a node between at least one of each two adjacent sections to be a roundabout lighting spot and a roundabout node respectively, and the light diffusion protective cover covers and secures the roundabout lighting spot and the roundabout node, thereby allowing the conductive wire between the roundabout lighting spot and the roundabout node to form a mounting ring.

9. The decorative net light structure according to claim 8, further comprising an auxiliary wire arranged adjacent to a last section of the light string;

wherein the auxiliary wire comprises a plurality of nodes corresponding to the plurality of lighting spots of the last section respectively, and the plurality of light diffusion protective covers cover and secure the plurality of lighting spots and the nodes corresponding to each other on the last section and auxiliary wire.

10. The decorative net light structure according to claim 8, further comprising an extension module;

wherein the extension module comprises a male connector, a female connector and two extension wires, the two extension wires connected between the male and female connectors and arranged adjacent to a first section and a last section of the light string, and at least one of the extension wires penetrating through at least one of the plurality of mounting rings;

wherein the extension wire arranged adjacent to the first section is electrically connected to the first circuit and comprises a plurality of positioning points corresponding to the plurality of nodes of the first section respectively, and the plurality of light diffusion protective covers cover and secure the plurality of nodes and the positioning points corresponding to each other on the first section and on the adjacent extension wire; and wherein the extension wire arranged adjacent to the last section is electrically connected to the second circuit and comprises a plurality of nodes corresponding to the plurality of lighting spots of the last section respectively, and the plurality of light diffusion protective covers cover and secure the plurality of lighting spots and the nodes corresponding to each other on the last section and on the adjacent extension wire.

11. The decorative net light structure according to claim 1, further comprising an auxiliary wire arranged adjacent to a last section of the light string;

wherein the auxiliary wire comprises a plurality of nodes corresponding to the plurality of lighting spots of the last section respectively, and the plurality of light diffusion protective covers cover and secure the plurality of lighting spots and the nodes corresponding to each other on the last section and auxiliary wire.

12. The decorative net light structure according to claim 11, wherein each one of the light diffusion protective covers is made of a transparent or semi-transparent material.

13. The decorative net light structure according to claim 12, wherein the at least one side surface further includes a second side surface, and the second side surface is a convex surface, concave surface or flat surface.

14. The decorative net light structure according to claim 13, wherein each of the at least one side surface is a glossy surface or a matte surface.

15. The decorative net light structure according to claim 14, wherein each one of the light diffusion protective covers has any one of a ball shape, a dome shape, a cylindrical shape, a rectangular shape and a polygonal shape.

16. The decorative net light structure according to claim 1, wherein each one of the light diffusion protective covers is made of a transparent or semi-transparent material.

17. The decorative net light structure according to claim 16, wherein the at least one side surface further includes a second side surface, and the second side surface is a convex surface, concave surface or flat surface.

18. The decorative net light structure according to claim 17, wherein each of the at least one side surface is a glossy surface or a matte surface.

19. The decorative net light structure according to claim 18, wherein each one of the light diffusion protective covers has any one of a ball shape, a dome shape, a cylindrical shape, a rectangular shape and a polygonal shape.

20. The decorative net light structure according to claim 16, wherein the at least one side surface further includes a second side surface, and the second side surface is a convex surface, concave surface or flat surface.

* * * * *